United States Patent [19]

Hayashi

[11] Patent Number: 4,662,318

[45] Date of Patent: May 5, 1987

[54] COOLING SYSTEM FOR AUTOMOTIVE INTERNAL COMBUSTION ENGINE OR THE LIKE

[75] Inventor: Yoshimasa Hayashi, Kamakura, Japan

[73] Assignee: Nissan Motor Co., Ltd., Yokohama, Japan

[21] Appl. No.: 798,922

[22] Filed: Nov. 18, 1985

[30] Foreign Application Priority Data

Nov. 20, 1984 [JP] Japan ..... 59-245268

[51] Int. Cl.[4] ..... F01P 3/22

[52] U.S. Cl. ..... 123/41.21; 123/41.44

[58] Field of Search ..... 123/41.2–41.27, 123/41.44

[56] References Cited

U.S. PATENT DOCUMENTS

| | | | |
|---|---|---|---|
| 1,632,586 | 6/1927 | Barlovx | 123/41.21 |
| 1,643,510 | 9/1927 | Muir | 123/41.21 |
| 1,649,246 | 11/1927 | Morrisey | 123/41.44 |
| 1,787,562 | 1/1931 | Barlow | 123/41.44 |
| 1,915,594 | 6/1933 | Cobb | 123/41.21 |
| 2,083,611 | 6/1937 | Marshall | 62/125 |
| 4,367,699 | 1/1983 | Evans | 123/41.54 |

FOREIGN PATENT DOCUMENTS

| | | |
|---|---|---|
| 0137410 | 4/1985 | European Pat. Off. . |
| 0143326 | 6/1985 | European Pat. Off. . |
| 714662 | 11/1941 | Fed. Rep. of Germany . |
| 154935 | 4/1922 | United Kingdom . |

*Primary Examiner*—William A. Cuchlinski, Jr.

*Attorney, Agent, or Firm*—Schwartz, Jeffery, Schwaab, Mack, Blumenthal & Evans

[57] ABSTRACT

A small capacity pump continuously driven by a mechanical connection with the crankshaft or the like of the engine, is arranged to induct coolant from both the radiator wherein the coolant vapor is condensed to its liquid state and a liquid/vapor separator disposed in the vapor transfer conduit via which the coolant vapor is conveyed to the radiator from the coolant jacket. In order to maintain the cylinder head exhaust valves and ports immersed in a predetermined depth of liquid coolant a level sensor is disposed in the coolant jacket and the output used to open and close a valve fluidly interposed between the radiator and the pump. If required a second valve can be interposed between the pump and the separator and arranged to be closed when the first one is open.

10 Claims, 8 Drawing Figures

COOLING SYSTEM FOR AUTOMOTIVE INTERNAL COMBUSTION ENGINE OR THE LIKE

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system which is simple, highly compact and which prevents relatively large amounts of engine coolant which "boil over" particularly at high engine load/speed operation, from reaching the condensor or radiator of the system in a manner which wets the interior of thereof to the point of reducing the efficiency with which the latent heat of evaporation of the coolant vapor can be released to the surrounding ambient atmosphere.

2. Description of the Prior Art

In currently used "water cooled" internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kgm of water may effectively remove from the engine under such conditions is 4 Kcal. Accordingly, in the case of an engine having 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course places a relatively large load parasitic on the engine and undesirably consumes a number of otherwise useful horsepower.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the large power consuming coolant circulation pump of the FIG. 1 arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water whereby, upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated as adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. Accordingly, air, due to this inherent tendency to rise, forms pockets of air which cause a kind of "embolism" blockage in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator, is constantly energized (apparently to obivate the need for level sensors and the like arrangement which could control the amount of coolant returned to the coolant jacket) the amount of coolant stored in the separation tank must be sufficient as to allow for sudden variations in the amount of coolant consumed in the coolant jacket due to sudden changes in the amount of fuel combusted in the combustion chambers of the engine.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the eramic layers, the vapor thus produced and which escapes into the coolant jacket inhibits the penetration of fresh liquid coolant and induces the situation wherein rapid overheat and thermal damage of the ceramic layers 12 and/or engine soon results.

FIG. 7 shows an arrangement which is disclosed in copending U.S. patent application Ser. No. 663,911 filed on Oct. 23, 1984 in the name of Hirano (Now U.S. Pat. No. 4,549,505 issued on Oct. 29, 1985). The disclosure of this application is hereby incorporated by reference thereto.

This arrangement has suffered from the drawback that upon being operated under prolonged high speed/-load conditions, the boiling in the coolant jacket above the engine cylinder head becomes sufficiently vigorous as to induce a relatively large amount of coolant to "boil over" (due to bumping and foaming of the liquid coolant) into the vapor transfer conduit and subsequently enter the radiator 126. The liquid coolant tends to wet the interior of the radiator tubing and reduce the surface area available for the vapor to release its latent heat of evaporation. Consequently, the heat exchange efficiency of the latter mentioned device is severely reduced at a time when maximum efficiency is most required.

In order to obviate this problem it is possible to add a separation tank of the nature disclosed in the above discussed U.S. Pat. No. 4,367,699. However, provision of same is very difficult in that it consumes a large amount of space which is simply not available in the extremely cramped engine compartments of modern automotive vehicles and if provided, due to the need to arrange same at a relatively high location on the engine (so as to enable the gravity feed effect utilized in connection therewith), it severely hampers even simple service operations such as spark plug replacement.

For convenience, the same numerals as used in the above mentioned patent application are also used in FIG. 7.

SUMMARY OF THE INVENTION

It is an object of the present invention to provide an evaporative type cooling system of an internal combustion engine or the like which is compact and which uses a single continuously operated coolant return pump to both return liquid coolant condensate from the condensor of the system and to induct liquid coolant which boils over from the coolant jacket of the system under given modes of operation back into the jacket before it can reach the condenser and wet the interior thereof in a manner which reduces the heat exchange efficiency of the device.

In brief, the above object is achieved by an arrangement wherein a small capacity pump continuously driven by a mechanical connection with the crankshaft or the like of the engine, is arranged to induct coolant from both the radiator wherein the coolant vapor is condensed to its liquid state and a liquid/vapor separator disposed in the vapor transfer conduit via which the coolant vapor is conveyed to the radiator from the coolant jacket. In order to maintain the cylinder head exhaust valves and ports immersed in a predetermined depth of liquid coolant, a level sensor is disposed in the coolant jacket and the output used to open and close a valve fluidly interposed between the radiator and the pump. If required a second valve can be interposed between the pump and the separator and arranged to be closed when the first one is open.

More specifically, a first aspect of the present invention is deemed to take the form of a cooling system for removing heat from heated structure of an internal combustion engine or the like, which is characterized by a cooling circuit which includes: a coolant jacket disposed about heated structure of the engine and into which coolant is introduced in liquid form and permitted to boil; a radiator in fluid communication with the coolant jacket for condensing the coolant vapor generated by the boiling for the liquid coolant therein; a continously operated pump fluidly interposed between the radiator and the coolant jacket, the pump being arranged to pump coolant into the coolant jacket; a level sensor disposed in the coolant jacket at a predetermined level above the heated structure; a level control valve fluidly interposed between the radiator and the pump, the level control valve selectively preventing communication between the radiator and the coolant jacket in response to the output of the level sensor.

Another aspect of the present invention comes in a method of removing heat from heated structure of an internal combustion engine or the like comprising the steps of: introducing liquid coolant into a coolant jacket disposed about heated structure of the engine; permitting the liquid coolant to boil and produce coolant vapor; condensing the coolant vapor generated by the boiling of the liquid coolant in a radiator in fluid communication with the coolant jacket; continously operating a coolant return pump fluidly interposed between the radiator and the coolant jacket, the pump being arranged to pump coolant into the coolant jacket; sensing the level of coolant in the coolant jacket using a level sensor disposed in the coolant jacket at a predetermined level above the heated structure; controlling the communication between the radiator and the pump using a level control valve fluidly interposed between the radiator and the pump, the level control valve selectively preventing communication between the radiator and the coolant jacket in response to the output of the level sensor.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the concepts on which the cooling system to which the present invention is applied.

Figure 5:
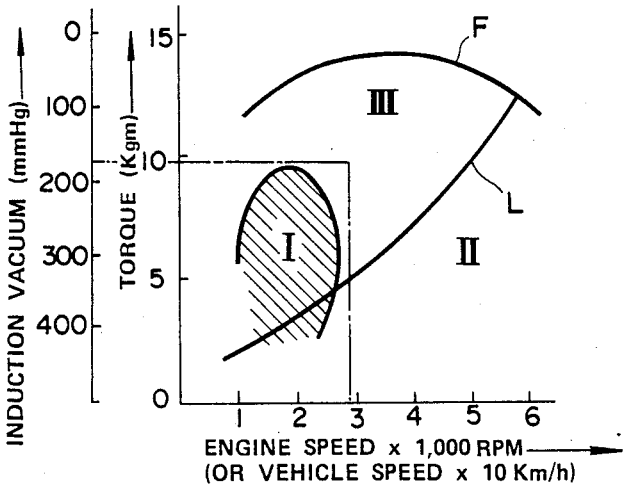
FIG. 5 is a graph showing in terms of induction vacuum (load) and engine speed the various load zones encountered by an automotive internal combustion engine.

FIG. 5 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110° C. while 90°-80° C. for zones II and III. The high temperature during "urban cruising" promotes improved thermal efficiency while in the other zones the lower temperatures ensure that sufficient heat is removed from the engine and associated structure to prevent engine knocking and/or engine damage. For operational modes which fall between the aforementioned first, second and third zones, it is possible to maintain the engine coolant temperature at approximately 100° C.

Figure 6:
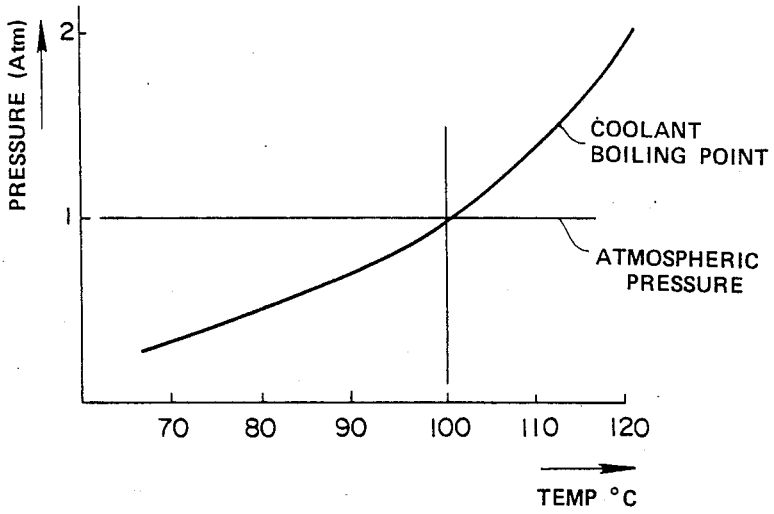
FIG. 6 is a graph showing in terms of pressure and temperature, the change which occurs in the coolant boiling point with change in pressure.
Figure 7:
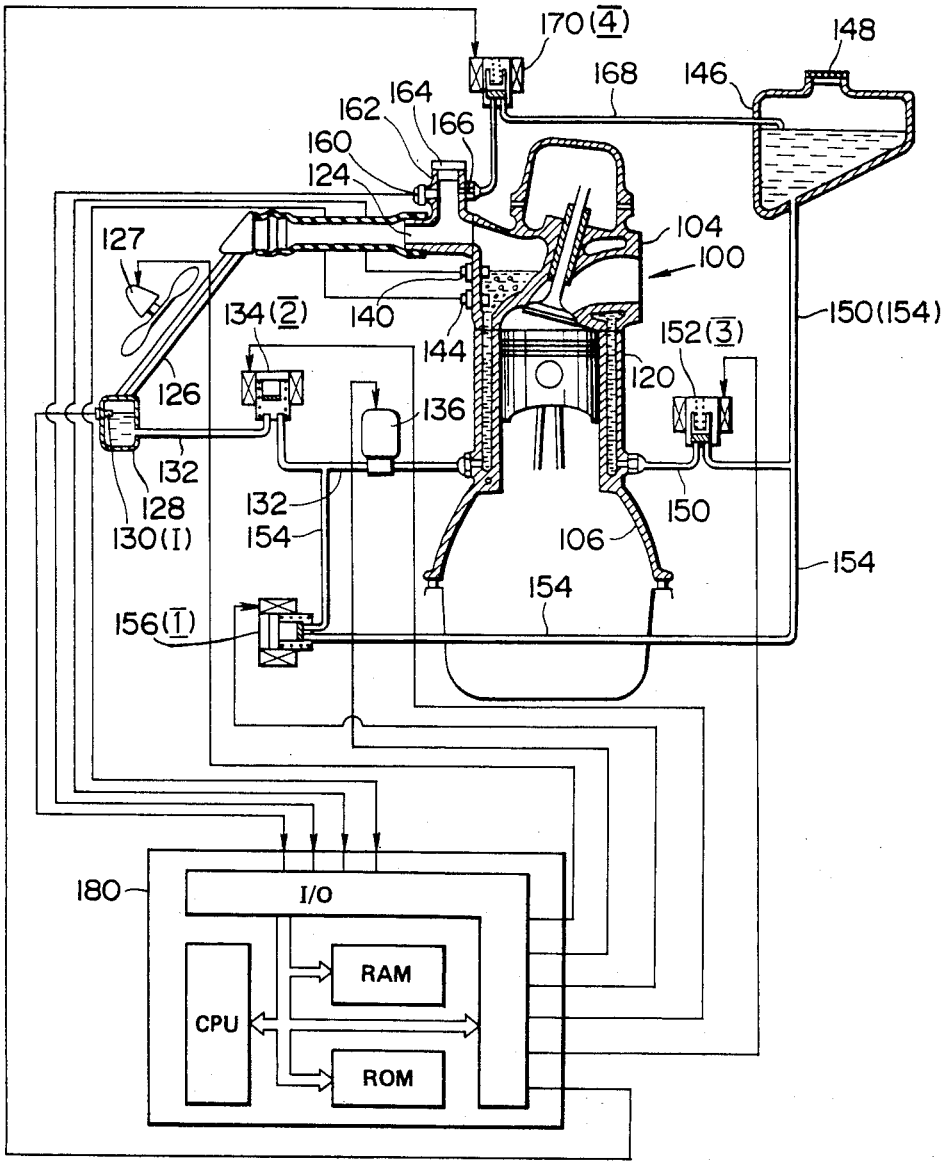
FIG. 7 shows in schematic elevation the arrangement disclosed in the opening paragraphs of the instant disclosure in conjunction with copending U.S. Ser. No. 663,911 (now U.S. Pat. No. 4,549,505)

With the present invention, in order to control the temperature of the engine, advantage is taken of the fact that with a cooling system wherein the coolant is boiled and the vapor produced used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 6, wherein the engine coolant boils at temperatures above 100° C. for example at approximately 119° C. (corresponding to a pressure of approximately 1.9 atmospheres).

On the other hand, during high speed cruising, it is further possible by increasing the flow of cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Figure 8:
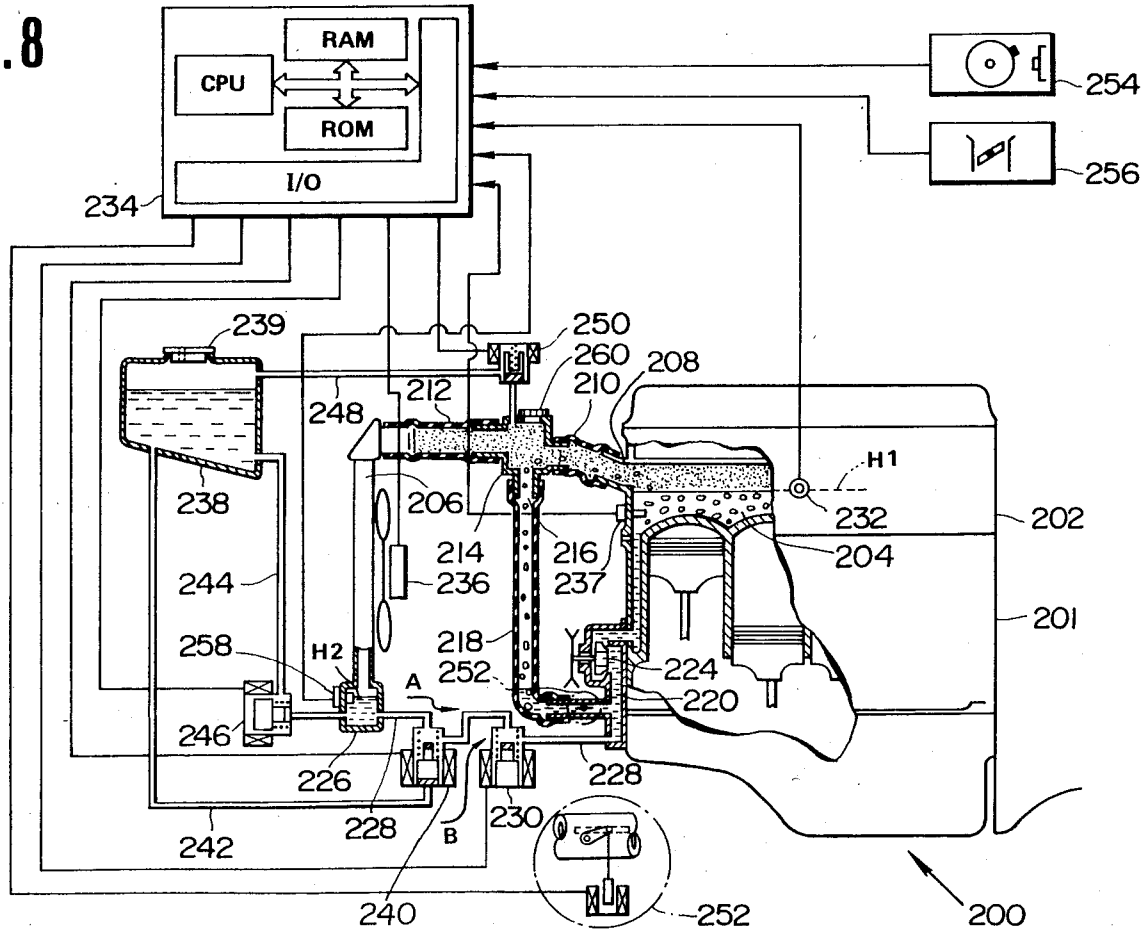
FIG. 8 shows in sectional elevation an embodiment of the present invention.

FIG. 8 shows an engine system incorporating a first embodiment of the present invention. In this arrangement, an internal combustion engine 200 includes a cylinder block 201 on which a cylinder head 202 is detachably secured. The cylinder head and cylinder block 202,201 include suitable cavities which define a coolant jacket 204 about the heated structure of the cylinder head and block.

A condenser or radiator 206 (as it will be referred to hereinafter) is fluidly communicated with vapor discharge port 208 by vapor transfer conduits 210, 212 and a liquid/vapor separator unit 214. This latter mentioned unit may include a baffle or baffles (not shown) located between an inlet port and an outlet port of the separator in a manner that any vapor and/or liquid coolant which enters the separator 214 is forced to undergo sharp changes in flow direction. These changes promote the tendency for liquid coolant to precipitate to the bottom of the device.

Figure 1:
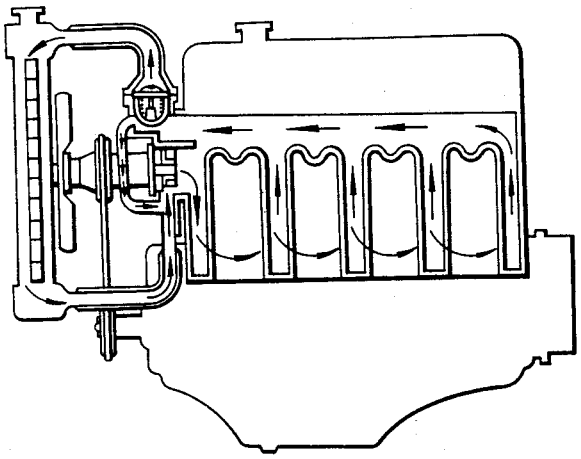
FIG.1 (PRIOR ART)
FIG. 1 is a partially sectioned elevation showing a currently used conventional water circulation type system discussed in the opening paragraphs of the instant disclosure.
Figure 2:
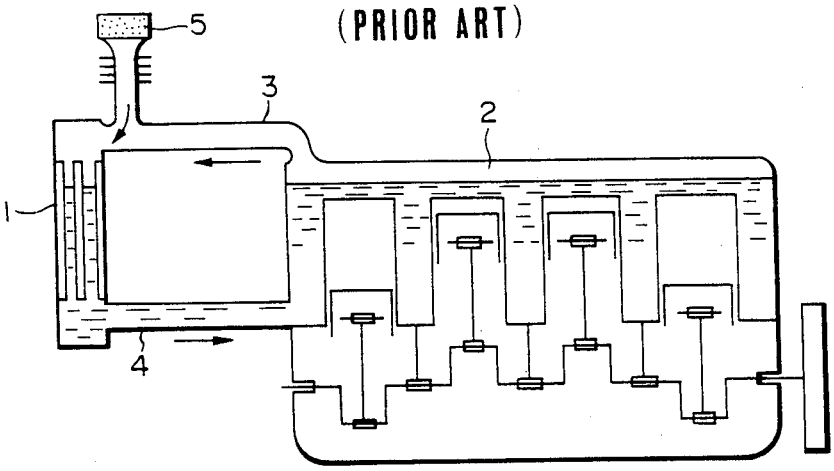
FIG.2 (PRIOR ART)
FIG. 2 is a schematic side sectional elevation of a prior art arrangement also discussed briefly in the earlier part of the specification.
Figure 3:
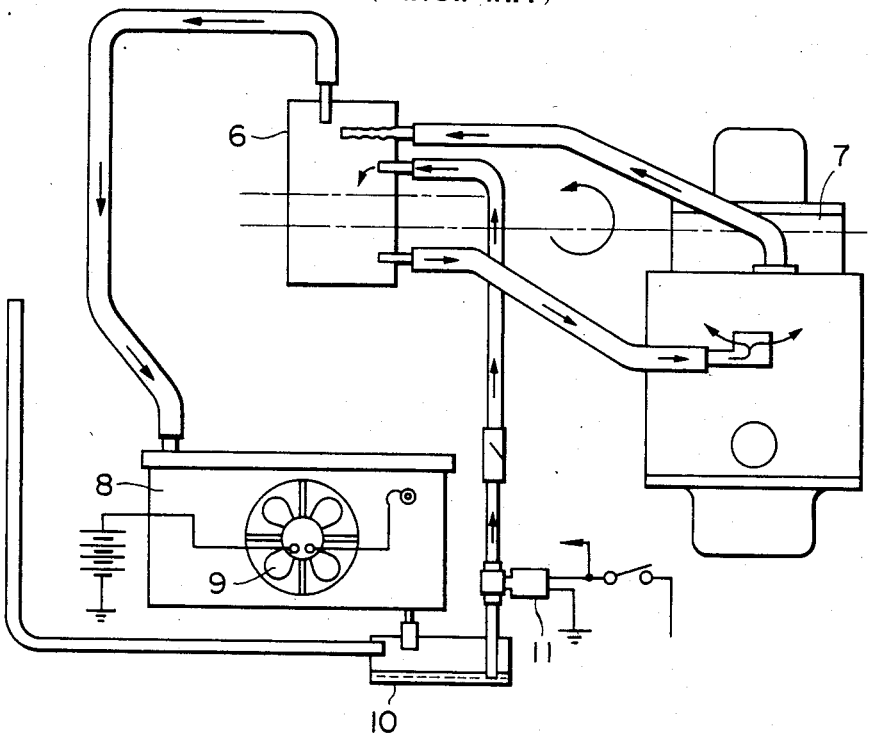
FIG.3 (PRIOR ART)
FIG. 3 shows in schematic layout form, another of the prior art arrangements previously discussed.
Figure 4:
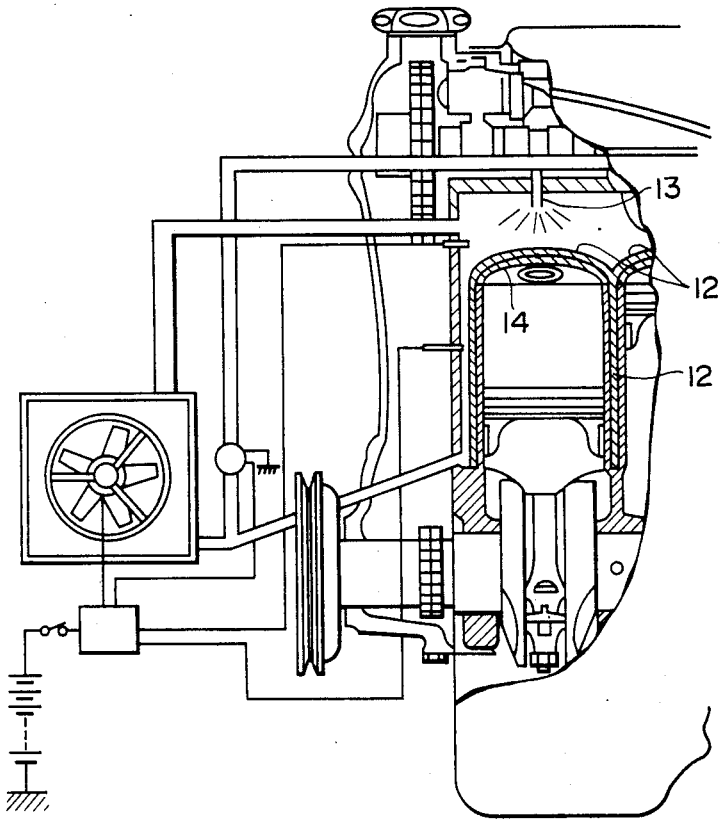
FIG.4 (PRIOR ART)
FIG. 4 shows in partial section yet another of the previously discussed prior art arrangements.

A drain port 216 is formed in the bottom of the separator and arranged to communicate via drain conduit 218 with the induction port 220 of a coolant return pump 224 which in this embodiment is of the centrifugal type and is driven via a mechanical connection with the engine 200. In this embodiment the pump 224 is driven by a belt (not shown) connected to a pulley connected to the engine crankshaft (neither shown). It should be noted that the capacity of pump 224 is approximately 1/10 of the corresponding device shown in FIG. 1.

A small collection vessel or lower tank 226 as it will be referred to hereinafter is provided at the bottom of the radiator 206 and adapted to collect the condensate (liquid coolant) which precipitates out of the heat exchanging tubes thereof.

A coolant return conduit 228 provides fluid commuication between the lower tank 226 and the induction port 220 of pump 224. A solenoid controlled ON/OFF type valve 230 is disposed in this conduit and arranged to cut-off fluid communication between the radiator 206 and the pump 224 when energized. In order to control this valve in a manner which maintains the desired amount of coolant in the coolant jacket 204, a level sensor 232 is disposed in the coolant jacket 204 and arranged to sense the level of coolant therein being below a predetermined minimum level H1. This level (H1) is selected to be such as to maintain the cylinder head, exhaust ports and valves (viz., engine structure subject to a high heat flux) immersed in a sufficient depth of liquid coolant as to obviate the possibility that, due to the bumping and or the like boiling phenomenon, localized dryouts do not occur within the coolant jacket 204 and give rise to localized overheating of the engine 200. As shown, the output of level sensor 232 is fed to a control circuit 234 which in this embodiment includes a microprocessor comprised of a RAM, ROM, CPU and an in/out interface I/O. The ROM of this circuit includes predetermined control programs which control the operation of the cooling system. In this embodiment the control circuit 234 is responsive to a signal from the level sensor 232 indicating that the level of coolant is below H1 in a manner to selectively de-energize valve 230 to permit coolant to be inducted from the lower tank 226 and pumped into the coolant jacket 204. In order to reduce the frequency with which valve 230 is opened and closed, it is possible to either provide level sensor 232 with hysteresis characteristics or arrange for the program which controls the valve to maintain valve 230 open for a period (which may be either preset or variable in response to the operational mode of the engine or the like) each time the level sensor 232 detects a low coolant level in the coolant jacket 204.

A fan or like device 236 is disposed adjacent the radiator 206 and arranged to induce a draft of air thereover upon energization. In order to control the fan in a manner to maintain the pressure within the cooling circuit (viz., a circuit comprised of the coolant jacket 204, separator 214, radiator 206 and interconnecting conduiting) a temperature sensor 237 is disposed in the coolant jacket 204. In this embodiment the temperature sensor 237 is arranged to be immersed in the liquid coolant (viz., disposed at a level lower than H1) and located relatively close to the highly heated structure of the engine. While it is possible to use a pressure sensor in lieu of a device which measures temperature per se, pressure sensors tend to be be expensive and subject to momentary pressure fluctations in a manner which tends to render the use thereof difficult. The location of the temperature sensor 237 close to the cylinder head has the advantage that if the coolant level should drop to a very low level the heat radiation from the hot engine structure will directly affect the sensor and enable the control circuit to recognize the dangerous lack of coolant.

A coolant reservoir 238 is located adjacent the engine. The interior of the reservoir is maintained constantly at atmospheric pressure via the provision of a suitable air bleed or like arrangement in the cap 239. This vessel is connected with the cooling circuit of the engine via a valve and coolant arrangement which includes: a three-way valve 240 disposed in the coolant return conduit 228 between valve 230 and the lower tank 226 and which in a first condition establishes flow path A (viz., fluid communication between the lower tank 226 and the pump 230) while in a second condition interrupts this communication and establishes flow path B (communication between the reservoir 238 and the pump 224 via a coolant supply conduit 242; a fill/discharge conduit 244 which leads from the reservoir 238 to the lower tank 226, a solenoid valve 246 which assumes a closed position wherein fluid communication between the reservoir 238 and the lower tank 246 is prevented when energized; and an overflow conduit 248 which leads from the top of the separator 214 to the reservoir 238. A normally closed solenoid valve 250 is disposed in this conduit and arranged to assume an open state when energized. It is also possible to arrange for this valve to open upon a pressure in excess of a predetermined maximum permissible value prevailing in the cooling circuit and thus function as a relief valve in addition to its normal function.

A flow control valve 252 can be disposed at the downstream end of the drain conduit 218 and arranged to assume a closed or throttling position when the valve 230 is opened so as to ensure positive induction of coolant from the lower tank 226. It should be noted that the provision of this valve is not essential to the operation of the invention and may be omitted in the event that adequate induction of coolant occurs between the lower tank 226 and the pump 224 in the absence of the same.

In order to sense the rotational speed and load on the engine, sensors 254, 256 are provided. The rotational speed sensor 254 may take the form of a crankshaft angular velocity sensor or a tap taken off the engine distributor or the like, while the load on the engine may be sensed by detecting the opening degree of the engine throttle valve, the induction vacuum or by using the output of an air flow meter. Alternatively, a fuel injection control signal can used to provide both load and RPM data. Vis., the frequency of the injection control pulses can be used to indicate engine speed while the width of the pulses used as an indication of load.

In order to sense the level of coolant in the lower tank 226 having reached a minimum permissible level (H2) a second level sensor 258 is disposed as shown.

Prior to use the cooling circuit is filled to the brim with coolant (for example water or a mixture of water and antifreeze or the like) via a filling port 260 formed in the separator unit 214 and a cap 260 securely set in place to seal the system. A suitable quantity of additional coolant is also placed in the reservoir 238. At this time the electromagnetic valve 246 should be temporarily energized or a similar precaution be taken to facilitate the complete filling of the system and the exclusion of any air.

When the engine 200 is started the control circuit 234 samples the output of temperature sensor 236 and if the temperature of the coolant is below a predetermined level (45° C. for example) the engine is deemed to be "cold" and a purge routine executed in order to ensure that prior to being put into normal operation, the system is completely free from contaminating air which will drastically reduce the heat exchange efficiency of radiator 206.

In order to execute this process, valve 246 is closed via energization, three-way valve 240 conditioned (via energization) to establish fluid communication between the reservoir 238 and pump 224 via conduit 242 (flow path B) and valves 230 and 250 are energized. Under these conditions coolant is inducted from the reservoir 238 and forced into the essentially full cooling circuit by pump 224. Accordingly, as the excess coolant is forced into the system, a corresponding amount overflows out through the overflow conduit 248 back to the reservoir 238. This flushes out any air that might have accumulated in the system and thus places the same in a contamination free condition ready for the excess coolant in the cooling circuit to be displaced out to the reservoir 238 until the levels in the coolant jacket 204 and lower tank 226 reach levels H1 and H2 respectively.

Following the purge operation valves 250, 246 and 240 are de-energized to cut off communication between the separator 214 and the reservoir 238, open conduit 244 and condition valve 240 to establish flow path A (viz., communicate pump 224 with lower tank 226).

As the coolant is not circulated through the radiator by pump 224, the heat produced by the combustion in the combustion chambers of the engine cannot be readily released to the ambient atmosphere and the coolant rapidly warms and begins to produce coolant vapor. At this time as valve 246 is left de-energized the pressure of the coolant vapor begins displacing liquid coolant out of the cooling circuit via fill/displacement conduit 244.

During this "coolant displacement mode" it is possible for either of two situations to occur. That is to say, it is possible for the level of coolant in the coolant jacket 204 to be reduced to level H1 before the level in the radiator 206 reaches level H2 or vice versa wherein the radiator 206 is emptied before much of the coolant in the coolant jacket 204 is displaced. In the event that latter occurs (viz., the coolant level in the radiator 206 falls to H2 before that in the coolant jacket 204 reaches H1), valve 246 is temporarily closed and the coolant in the coolant jacket 204 allowed to "distill" across to the radiator 206. Alternatively, if the level H1 is reached first, level sensor 232 induces the de-energization of valve 230 and coolant is pumped from the lower tank 226 to the coolant jacket 204 while simultaneously being displaced out through conduit 244 to reservoir 238.

During this displacement mode, the load and other operational parameters of the engine are determined by sampling the inputs from sensors 254, 256 and a decision made as to the temperature at which the coolant should be controlled to boil. If the desired or "target" temperature is reached before the amount of the coolant in the cooling circuit is reduced to the minimum quantity (viz., the quantity defined when the coolant in the coolant jacket and the radiator are at levels H1 and H2 respectively) it is possible to energize valve 246 so that is assumes a closed state and places the cooling circuit in a hermetically closed condition. If the temperature at which the coolant boils should exceed that determined to be best suited for the instant set of engine operational conditions, the circuit may be subsequently reopened and additional coolant displaced out to reservoir 238 to increase the surface "dry" surface area of the radiator 206 available for the coolant vapor to release its latent heat of evaporation.

In operation the above described arrangement is such that when the levels of coolant in the coolant jacket 204 and the lower tank 226 have reached levels H1 and H2 respectively, valve 246 should be closed to prevent the possibility of overdischarging the coolant and leaving the system without sufficient coolant to ensure safe operation.

Upon the load on the engine being increased beyond a predetermined level, the boiling action in the coolant jacket in the region of the cylinder heads exhaust ports and like structure, becomes sufficiently vigorous as to produce bumping and frothing to the degree that a relatively large amount of liquid coolant tends to enter conduit 210. However, due to the provision of separator 214 little or none of this liquid coolant is permitted to reach the radiator 206 and is recycled to the coolant jacket 204 via pump 224. Although not set forth hereinbefore, it will be understood that once the engine is stopped and has cooled sufficiently under the control of a suitable "cool down" control program, the coolant in the reservoir is allowed to be inducted into the cooling circuit under the influence of the pressure differential which develops between the atmosphere and the interior of the cooling circuit as the coolant vapor condenses to its liquid form, until the cooling circuit is completely filled.

In the event that when the engine is restarted and the engine coolant is above 45° C. then it can be assumed that there has been insufficient time for contaminating air to enter the system and the purge operation can be omitted.

With the arrangement of the present invention due to the dual use of a single pump, the need for a plurality of electrically powered pumps is avoided and thus reduces the electrical power consumption incurred thereby. Further, the associated conduiting which tends to clutter the crowded environment of the engine compartment is also reduced.

For further disclosure relating to the operation and control of the above valve and conduit arrangement reference may be had to co-pending U.S. patent application Ser. No. 704 269 filed on Feb. 22, 1985 in the name of Hayashi et al.

What is claimed is:

1. In an internal combustion engine a cooling system for removing heat from heated structure of said engine, said cooling system comprising a cooling circuit which includes:

a coolant jacket disposed about heated structure of said engine and into which coolant is introduced in liquid form and permitted to boil;

a radiator in fluid communication with said coolant jacket for condensing the coolant vapor generated by the boiling of the liquid coolant therein;

a continuously operated pump fluidly interposed between said radiator and said coolant jacket, said pump being arranged to pump coolant into said coolant jacket;

a level sensor disposed in said coolant jacket at a predetermined level above the heated structure; and a level control valve fluidly interposed between said radiator and said pump, said level control valve selectively preventing communication between said radiator and an induction side of said pump in response to the output of said level sensor.

2. A method of removing heat from heated structure of an internal combustion engine comprising the steps of:

introducing liquid coolant into a coolant jacket disposed about the heated structure of said engine;

permitting the liquid coolant to boil and produce coolant vapor;

condensing the coolant vapor generated by the boiling of the liquid coolant in a radiator in fluid communication with the coolant jacket;

continuously operating a coolant return pump fluidly interposed between said radiator and said coolant jacket, said pump being arranged to pump coolant into said coolant jacket;

sensing the level of coolant in the coolant jacket using a level sensor disposed in said coolant jacket at a predetermined level above the heated structure; and controlling the communication between the radiator and the pump using a level control valve fluidly interposed between said radiator and said pump, said level control valve selectively preventing communication between said radiator and the induction side of said pump in response to said level sensor indicating that the level of coolant in said coolant jacket is above said predetermined level.

3. In an internal combustion engine a cooling system for removing heat from heated structure of said engine, said cooling system comprising a cooling circuit which includes:

a coolant jacket disposed about heated structure of said engine and into which coolant is introduced in liquid form and permitted to boil;

a radiator in fluid communication with said coolant jacket for condensing the coolant vapor generated by the boiling of the liquid coolant therein;

a continuously operated pump fluidly interposed between said radiator and said coolant jacket, said pump being arranged to pump coolant into said coolant jacket;

a level sensor disposed in said coolant jacket at a predetermined level above the heated structure;

a level control valve fluidly interposed between said radiator and said pump, said level control valve selectively preventing communication between said radiator and said coolant jacket in response to the output of said level sensor;

a vapor transfer conduit leading from said coolant jacket to said radiator and through which the coolant vapor generated in said coolant jacket is transferred to said radiator for condensation therein; and a separator disposed in said vapor transfer conduit for separating liquid coolant from the coolant vapor at a location upstream of said radiator, said separator having a drain port in fluid communication with said pump.

4. In an internal combustion engine a cooling system for removing heat from heated structure of said engine, said cooling system comprising a cooling circuit which includes:

a coolant jacket disposed about heated structure of said engine and into which coolant is introduced in liquid form and permitted to boil;

a radiator in fluid communication with said coolant jacket for condensing the coolant vapor generated by the boiling of the liquid coolant therein;

a continously operated pump fluidly interposed between said radiator and said coolant jacket, said pump being arranged to pump coolant into said coolant jacket;

a level sensor disposed in said coolant jacket at a predetermined level above the headed structure;

a level control valve fluidly interposed between said radiator and said pump, said level control valve selectively preventing communication between said radiator and said coolant jacket in response to the output of said level sensor;

a reservoir containing liquid coolant, said reservoir being discrete from said cooling circuit; and valve and conduit means for selectively controlling fluid communication said reservoir and said cooling circuit.

5. A cooling system as claimed in claim 4 wherein said level control valve is disposed in a coolant return conduit which leads from the bottom of said radiator to said continuously operated pump and wherein said valve and conduit means comprises:

a first three-way valve disposed in said coolant return conduit at a location between said radiator and said level control valve, said first valve having a first position wherein communication between said radiator and said level control valve is established and a second position wherein communication between said reservoir and said level control valve is estabished via a supply conduit which leads from said reservoir to said first valve;

a second valve disposed in a supply/displacement conduit which leads from said reservoir to said cooling circuit at a location lower than said predetermined level; and a third normally closed valve disposed in an overflow conduit which leads from said reservoir to said coolant circuit and which communicates with said cooling circuit at at level higher than said predetermined level.

6. A cooling system as claimed in claim 5, further comprising:

a small collection vessel disposed at the bottom of said radiator for collecting the liquid coolant condensate which precipitates thereoutof; and a second level sensor disposed in said collection vessel, said second level sensor being arranged to detect the level of coolant in said collection vessel being lower than a second level which is selected to lower than the heat exchanging surface area of said radiator.

7. In an internal combustion engine a cooling system for removing heat from heated structure of said engine, said cooling system comprising a cooling circuit which includes:

a coolant jacket disposed about heated structure of said engine and into which coolant is introduced in liquid form and permitted to boil;

a radiator in fluid communication with said coolant jacket for condensing the coolant vapor generated by the boiling of the liquid coolant therein;

a continously operated pump fluidly interposed between said radiator and said coolant jacket, said pump being arranged to pump coolant into said coolant jacket;

a level sensor disposed in said coolant jacket at a predetermined level above the heated structure;

a level control valve fluidly interposed between said radiator and said pump, said level control valve selectively preventing communication between said radiator and said coolant jacket in response to the output of said level sensor;

a load sensor for sensing the load on said engine;

a temperature sensor disposed in said coolant jacket in a manner to be immersed in said liquid coolant;

a device disposed adjacent said radiator for varying the rate of heat exchange between said radiator and a cooling medium surrounding the same; and a control circuit responsive to the output of said temperature sensor and said load sesor for controlling said device in a manner which when said load sensor indicates the load on said engine is below a predetermined level, induces a rate of heat exchange between said radiator and the cooling medium which induces a rate of condensation of coolant vapor in the radiator which causes the coolant to boil at a first preselected temperature and which when said load sensor indicates that the load on the engine is above said predetermined level increases the rate of heat exchange between said radiator and the cooling medium to a level whereat the coolant boils at a temperature lower than said preselected temperature.

8. In an internal combustion engine a cooling system for removing heat from heated structure of said engine, said cooling system comprising a cooling circuit which includes:

a coolant jacket disposed about heated structure of said engine and into which coolant is introduced in liquid form and permitted to boil;

a radiator in fluid communication with said coolant jacket for condensing the coolant vapor generated by the boiling of the liquid coolant therein;

a continously operated pump fluidly interposed between said radiator and said coolant jacket, said pump being arranged to pump coolant into said coolant jacket;

a level sensor disposed in said coolant jacket at a predetermined level above the heated structure;

a level control valve fluidly interposed between said radiator and said pump, said level control valve selectively preventing communication between said radiator and said coolant jacket in response to the output of said level sensor; and a throttle valve fluidly interposed between said separator and said continuously operated pump, said throttle valve being arranged to assume a closed position wherein it throttles communication between said separator and said continuously operated pump when said level control valve assumes a condition wherein fluid communication between said radiator and said continuously operated pump is established.

9. A method of removing heat from heated structure of an internal combustion engine, comprising the steps of:

introducing liquid coolant into a coolant jacket disposed about the heated structure of said engine;

permitting the liquid coolant to boil and produce coolant vapor;

condensing the coolant vapor generated by the boiling of liquid coolant in a radiator in fluid communication with the coolant jacket;

continously operating a coolant return pump fluidly interposed between said radiator and said coolant jacket, said pump being arranged to pump coolant into said coolant jacket;

sensing the level of coolant in the coolant jacket using a level sensor disposed in said coolant jacket at a predetermined level above the heated structure;

controlling the communication between the radiator and the pump using a level control valve fluidly interposed between said radiator and said pump, said level control valve selectively preventing communication between said radiator and the induction side of said pump in response to said level sensor indicating that the level of coolant in said coolant jacket is above said predetermined level;

a separating the liquid and gaseous coolant discharged from said coolant jacket in a separator disposed between said coolant jacket and said radiator; and draining the liquid coolant separated in said separator to said continously operated pump for return to said coolant jacket.

10. A method as claimed in claim 9 further comprising the step of selectively throttling the communication between said separator and said continuously operated pump when communication between said radiator and said continuously operated pump is established by said level control valve.

* * * * *